US008857370B2

(12) United States Patent
Kida et al.

(10) Patent No.: US 8,857,370 B2
(45) Date of Patent: Oct. 14, 2014

(54) COATED PAPER MAKING APPARATUS AND METHOD

(75) Inventors: Shinzo Kida, Tokyo (JP); Keisuke Towatari, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/594,117

(22) Filed: Aug. 24, 2012

(65) Prior Publication Data

US 2012/0328772 A1 Dec. 27, 2012

Related U.S. Application Data

(63) Continuation of application No. PCT/JP2010/053093, filed on Feb. 26, 2010.

(51) Int. Cl.

| | |
|---|---|
| ***B05C 11/00*** | (2006.01) |
| ***B05D 7/00*** | (2006.01) |
| ***D21H 27/00*** | (2006.01) |
| ***A24D 1/02*** | (2006.01) |
| ***D21H 19/12*** | (2006.01) |
| ***D21H 23/22*** | (2006.01) |
| ***A24C 5/00*** | (2006.01) |

(52) U.S. Cl.

CPC ..... *A24D 1/025* (2013.01); *D21H 27/00* (2013.01); *D21H 19/12* (2013.01); *D21H 23/22* (2013.01); *A24C 5/005* (2013.01)

USPC ..... 118/712

(58) Field of Classification Search

None

See application file for complete search history.

(56) References Cited

U.S. PATENT DOCUMENTS

| | | | | |
|---|---|---|---|---|
| 4,237,907 | A * | 12/1980 | Pawelko et al. | 131/286 |
| 4,265,255 | A * | 5/1981 | Helms | 131/69 |
| 5,600,900 | A * | 2/1997 | Marschke | 34/519 |
| 6,619,292 | B2 * | 9/2003 | Saitou | 131/68 |
| 7,234,471 | B2 * | 6/2007 | Fitzgerald et al. | 131/365 |
| 7,275,548 | B2 * | 10/2007 | Hancock et al. | 131/35 |
| 7,276,120 | B2 * | 10/2007 | Holmes | 118/325 |
| 7,281,540 | B2 * | 10/2007 | Barnes et al. | 131/284 |
| 7,363,929 | B2 * | 4/2008 | Fagg et al. | 131/35 |
| 7,448,390 | B2 * | 11/2008 | Barnes et al. | 131/35 |
| 7,775,217 | B2 * | 8/2010 | Seymour et al. | 131/282 |
| 2005/0252516 | A1 * | 11/2005 | Izumiya et al. | 131/280 |
| 2006/0037619 | A1 * | 2/2006 | Ishikawa et al. | 131/280 |

(Continued)

FOREIGN PATENT DOCUMENTS

| | | |
|---|---|---|
| EP | 1 611 804 A1 | 1/2006 |
| EP | 1 614 803 A1 | 1/2006 |

(Continued)

*Primary Examiner* — Dah-Wei D Yuan
*Assistant Examiner* — Jethro Pence
(74) *Attorney, Agent, or Firm* — Birch, Stewart, Kolasch & Birch, LLP

(57) ABSTRACT

Apparatus for making coated paper serving as lower ignition propensity paper for cigarettes has a transport path (L) for a web (W), a coating unit (10) arranged on the path (L) to apply a combustion inhibition material to the web (W), a pre-dryer (16) for drying the web (W) with the material applied, a gravure roller (22) arranged downstream of the pre-dryer (16) to apply water to the web (W), a drying roller (34) arranged downstream of the roller (22) to post-dry the web (W), a smoothing roller (32) arranged between the roller (22) and the roller (34) to flatten wrinkles in the web (W) passing around the roller (32), a displacement sensor (42) for measuring wrinkles in the web (W) having passed around the roller (34), and a controller (44) for controlling tension in the web (W) on the basis of measurements received from the sensor (42).

7 Claims, 7 Drawing Sheets

(56) References Cited

U.S. PATENT DOCUMENTS

| | | | | |
|---|---|---|---|---|
| 2006/0076026 | A1* | 4/2006 | Matsuura et al. | 131/280 |
| 2006/0207617 | A1* | 9/2006 | Seymour et al. | 131/284 |
| 2006/0254735 | A1* | 11/2006 | Ono et al. | 162/136 |
| 2007/0039628 | A1* | 2/2007 | Aizawa et al. | 131/281 |
| 2009/0301506 | A1* | 12/2009 | Kida et al. | 131/365 |

FOREIGN PATENT DOCUMENTS

| | | | | | |
|---|---|---|---|---|---|
| JP | 64-087460 | A | | 3/1989 | |
| JP | 01-221592 | A | | 9/1989 | |
| JP | 02-234994 | A | | 9/1990 | |
| JP | 04-265696 | A | | 9/1992 | |
| JP | 06-142590 | | * | 5/1994 | B05C 5/02 |
| JP | 06-142590 | A | | 5/1994 | |
| JP | 2858385 | B2 | | 2/1999 | |
| JP | 2003-211051 | A | | 7/2003 | |
| JP | 2010-012686 | A | | 1/2010 | |
| WO | WO 2004/088038 | A1 | | 10/2004 | |
| WO | WO 2004/089120 | A1 | | 10/2004 | |
| WO | WO 2009/099011 | A1 | | 8/2009 | |

* cited by examiner

COATED PAPER MAKING APPARATUS AND METHOD

This application is a Continuation of PCT Application No. PCT/JP2010/053093 filed on Feb. 26, 2010. The entire contents are hereby incorporated by reference into the present application.

TECHNICAL FIELD

This invention relates to coated paper making apparatus and method suited to make wrinkleless coated paper.

BACKGROUND ART

Recently, coated paper of this type serving as lower ignition propensity paper for cigarettes is becoming known. The lower ignition propensity paper can reduce the risk of spread of fire to combustible materials even if an ignited cigarette wrapped in this paper drops thereon. Specifically, coated paper serving as lower ignition propensity paper is obtained by applying bands of a liquid-form lower ignition propensity material to a web at predetermined longitudinal intervals, and then drying. However, applying a liquid-form lower ignition propensity material to the web surface in this manner leads to production of longitudinal wrinkles in the web during drying, and thus, the resulting coated paper, or lower ignition propensity paper has deteriorated quality.

To remove the longitudinal wrinkles, an idea of providing a smoothing roller on a web transport path has been presented. The smoothing roller has a circumference with a pair of elastic helical ridges arranged symmetrically with respect to a center position dividing the length of the smoothing roller into halves (patent document 1).

PRIOR-ART DOCUMENT

Patent Document

Patent document 1: Japanese Patent No. 2858385 Publication

SUMMARY OF THE INVENTION

Problem to be Solved by the Invention

Wrinkles produced in the web vary in size though the smoothing roller is used. Thus, in the prior art, use of the smoothing roller entails monitoring wrinkles in the web by eye or touch and manually regulating the pressing force exerted by the smoothing roller on the web, or in other words, the tension of the web. Such monitoring however does not provide quantitative grasping of wrinkles in the web. It is therefore difficult to maintain optimal tension in the web. Insufficient or excessive tension damages the quality of paper, because the former leads to wrinkles remaining in the web and the latter to breaks in the web.

The present invention has been made in consideration of the above problem. An object of the present invention is to provide coated paper making apparatus and method capable of making high-quality coated paper by grasping wrinkles quantitatively and regulating tension in the web optimally, thereby removing wrinkles from the web effectively.

Means for Solving the Problem

In order to achieve the above object, coated paper making apparatus comprises: a transport path along which a web to be formed into coated paper is transported; a liquid-form coating material coating unit arranged on the transport path to apply a liquid-form coating material to one side of the web; a pre-dryer arranged downstream of the liquid-form coating material coating unit to dry the web; a water coating unit arranged downstream of the pre-dryer to apply water to the web, all over a surface thereof; a post-dryer arranged downstream of the water coating unit to dry the web; a smoothing roller rotatably arranged between the water coating unit and the post-dryer to flatten wrinkles in the web passing around the smoothing roller; measurement means for measuring wrinkles possibly remaining in the web having passed through the post-dryer and supplying measurements; and quality control means for managing the measurements received from the measurement means.

The web is coated with a liquid-form coating material, then pre-dried, and then water is applied to the web, all over a surface thereof. Thus, if wrinkles are produced in the web during pre-drying, such wrinkles are softened with water applied. The web with the wrinkles thus softened then passes around the smoothing roller. The smoothing roller can therefore satisfactorily flatten the wrinkles in the web passing around the smoothing roller.

When the web having passed around the smoothing roller is dried at the post-dryer, production of wrinkles in the web during this drying process is satisfactorily suppressed, because of the water applied to the web all over the surface.

The coated paper making apparatus further comprises the measurement means and the quality control means, which make it possible to quantitatively determine wrinkles possibly remaining in the web, collect and record data related to wrinkles in the web, and quantitatively grasp the quality of the web.

Specifically, the measurement means desirably includes a displacement sensor arranged at a predetermined distance from the transport path to measure a distance between itself and the web moving on the transport path, and a linear slider for making the displacement sensor reciprocate across the moving web, at the predetermined distance from the transport path.

The measurement means may further include a backing roller arranged opposite the displacement sensor with the transport path between, to contact a side of the moving web opposite to the side with the coating material applied, thereby guiding the moving web. In this case, the circumference of the backing roller contacting the moving web provides a criterion for the displacement sensor's measurement, enabling accurate measurement of wrinkles remaining in the web.

The coated paper making apparatus may further comprise a tension regulation means for regulating tension in the web passing around the smoothing roller so that the quality control means controls the tension in the web, through the tension regulation means, on the basis of the measurements received from the measurement means.

Specifically, the coated paper making apparatus may be arranged such that the post-dryer includes a drying roller for drying the web passing around the drying roller and the tension regulation means includes an adjustable-speed motor for driving the drying roller at variable peripheral speed. In this case, the tension in the web can be regulated by means of the drying roller depending on wrinkles remaining in the web. This enables effective removal of remaining wrinkles from the web, and thus, great improvement in web quality.

The post-dryer may further include a pair of pressing rollers arranged apart from each other in a circumferential direction of the drying roller to press the moving web against the circumference of the drying roller. This helps the web moving around the drying roller to be dried satisfactorily.

In order to make coated paper serving as lower ignition propensity wrapping paper for cigarettes, the liquid-form coating material coating unit of the coated paper making apparatus may be arranged to apply a liquid-form combustion inhibition material to the moving web, intermittently, thereby forming bands of the combustion inhibition material on the web.

A coated paper making method comprises steps of: applying a liquid-form coating material to one side of a web to be formed into coated paper, the web moving on a transport path; pre-drying the web with the liquid-form coating material applied; applying water to the pre-dried web, all over a surface thereof; post-drying the web with the water applied; smoothing wrinkles in the web with the water applied, by means of a smoothing roller, before the post-drying; measuring wrinkles in the post-dried web; and managing measurements obtained in the measurement.

Effect of the Invention

The coated paper making apparatus and method according to the present invention can provide a web with improved quality by grasping wrinkles in the web quantitatively and regulating tension in the web optimally, thereby removing wrinkles from the web effectively.

MODE OF CARRYING OUT THE INVENTION

Figure 1:
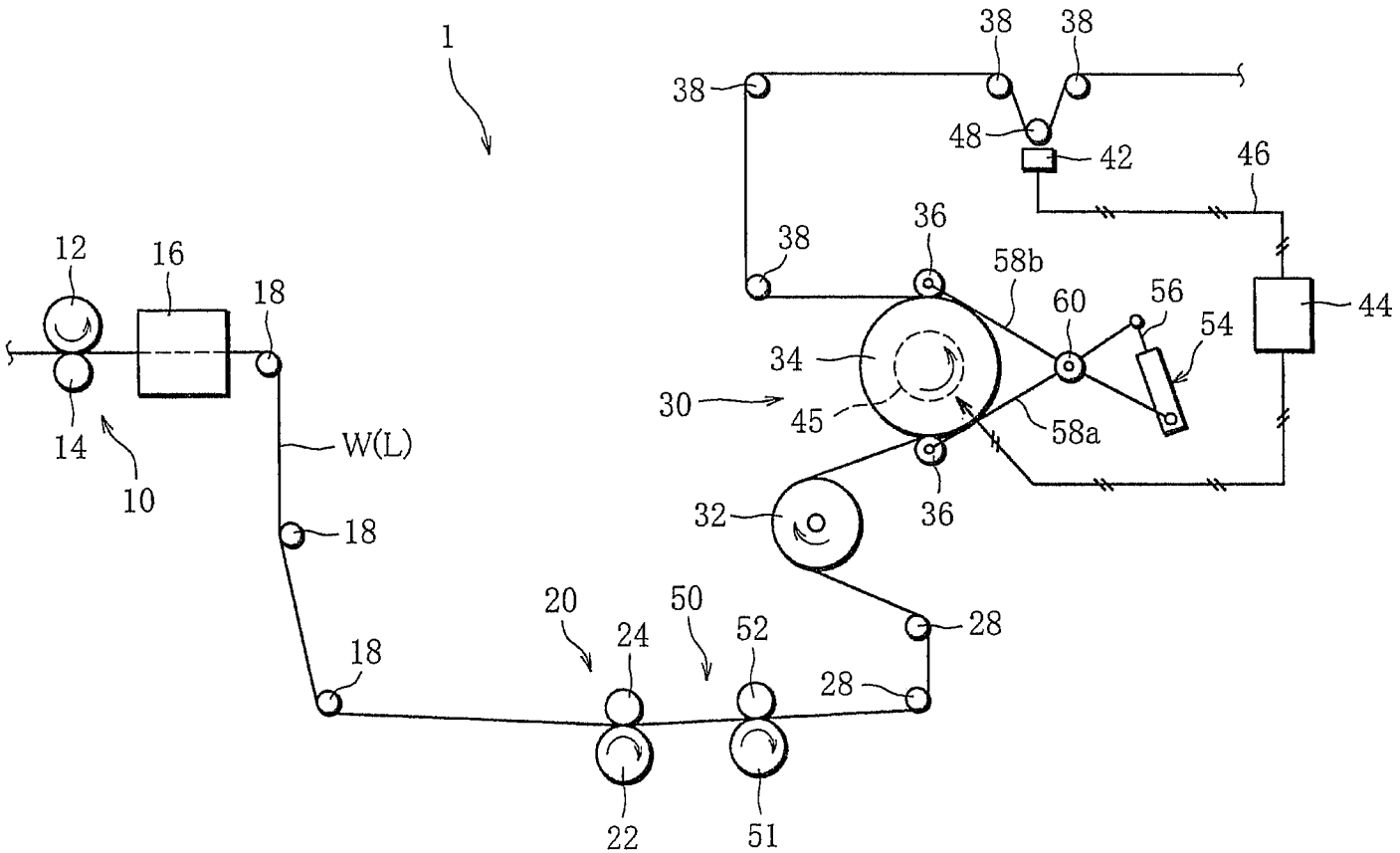
FIG. 1 is a diagram schematically showing an embodiment of coated paper making apparatus according to the present invention for making coated paper serving as wrapping paper for lower propensity ignition cigarettes.

As shown in FIG. 1, apparatus 1 for carrying out a method according to the present invention comprises a transport path L along which a web W to be formed into wrapping paper for lower ignition propensity cigarettes is transported. The transport path L is defined by guide rollers 18, 28, 38 and other elements. The web W is fed from a supply reel (not shown) to a take-up reel (not shown) along the transport path L, and wound on the take-up reel.

Figure 2:
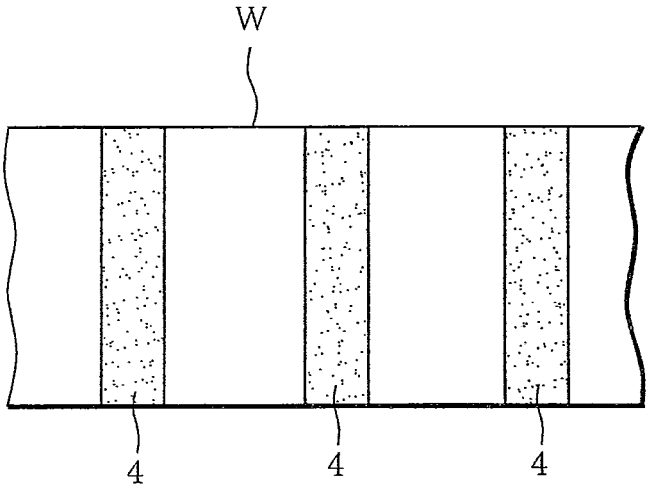
FIG. 2 is a diagram showing wrapping paper with bands, made by the apparatus shown in FIG. 1.

On the transport path L, at an upstream location, there is arranged a coating unit 10. The coating unit 10 includes a gravure roller 12 and a pinch roller 14 arranged on the opposite sides of the web W on the transport path L. The gravure roller 12 applies a liquid-form coating material, or combustion inhibition material to one side of the web W passing between the gravure roller 12 and the pinch roller 14, which side will be referred to as "front side". Specifically, the combustion inhibition material is for example an aqueous solution of alginate sodium or pectin, and applied to the web W at predetermined intervals along a transporting direction of the web W. Thus, as shown in FIG. 2, a large number of bands 4 of the combustion inhibition material are formed on the web W to extend across the web W and be separated from each other by a predetermined distance along the transporting direction.

Downstream of the coating unit 10, a drying furnace 16 is arranged on the transport path L. The web W with the combustion inhibition material applied passes inside the drying furnace 16 functioning as a pre-dryer. The drying furnace 16 has a plurality of hot-air nozzles (not shown) inside. The hot-air nozzles emit a jet of hot air inside the drying furnace 16, thereby keeping the furnace inside at drying temperature of 100 to 50° C. Thus, inside the drying furnace 16, the combustion inhibition material, or bands 4 on the web W are dried.

The bands 4 formed on the front side of the web W by applying the combustion inhibition material thereto cause a difference in shrinkage ratio between regions of the web with the combustion inhibition material (band 4) applied and regions of the web without the combustion inhibition material applied, and thus, produces wrinkles, specifically longitudinal wrinkles in the web W.

A water coating unit 20 is therefore arranged on the transport path L, downstream of the drying furnace 16. The water coating unit 20 applies water to the back side of the web W passing through the unit 20. The back side is opposite to the front side with the combustion inhibition material applied.

More specifically, the water coating unit 20 includes a gravure roller 22 and a pinch roller 24 arranged on the opposite sides of the web W on the transport path L, and the gravure roller 22 applies water to the back side of the web W passing between the rollers 22 and 24, all over the surface. The amount of water applied is desirably about 3 to 10 g/m$^2$, for example.

Downstream of the water coating unit 20, a feed roller unit 50, a smoothing roller 32 and a drying unit 30 are arranged serially on the transport path L.

The feed roller unit 50 includes a feed roller 51 and a pinch roller 52 arranged on the opposite sides of the web W on the transport path L to feed the web W at a constant rate.

Figure 3:
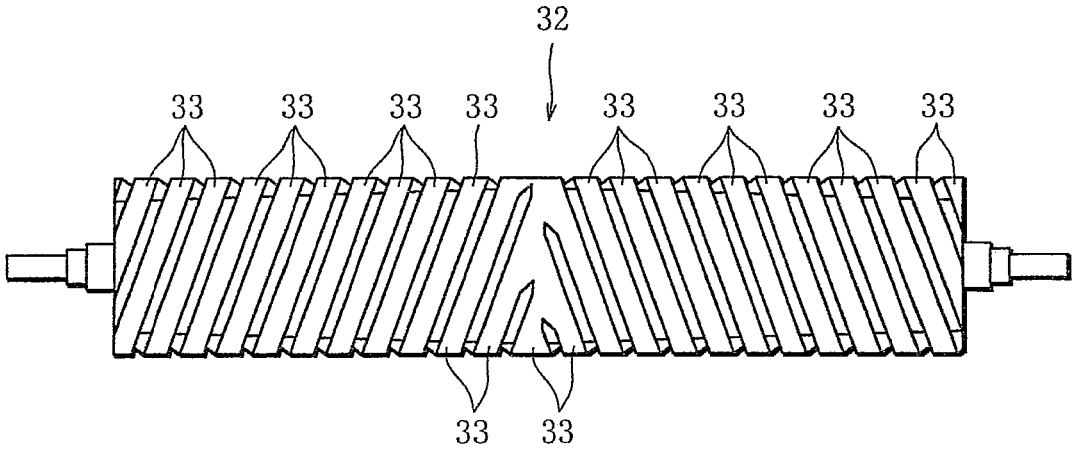
FIG. 3 is an enlarged view of a smoothing roller shown in FIG. 1.

As shown in FIG. 3, the smoothing roller 32 has a circumference with a pair of helical ridges 33 arranged on the left and right sides. The helical ridges 33 have elasticity and form symmetry with respect to the center position divining the length of the smoothing roller 32 into halves, and each helically extend from the center position to an end of the roller 32. Such helical ridges 33 define helical grooves on the circumference of the smoothing roller 32. Each helical groove is an inclined V-groove of which a roller end-side wall is only inclined, and has a depth gradually increasing from the center position towards the roller end. This allows each helical ridge 33 to elastically deform to incline toward the roller end.

Next, with reference to FIG. 4, smoothing function of the smoothing roller 32 will be described in detail.

Let us focus on a specific portion of the circumference of the smoothing roller 32 and suppose that this portion has just come into contact with the moving web W. At this time, the top of the helical ridges 33 at this portion of the circumference contacts the back side of the web W, as depicted in a solid line in FIG. 4. As the smoothing roller rotates, the force exerted by the web W winding around the smoothing roller 32 on this portion of the circumference increases, so that, at this portion of the circumference, the helical ridges 33 elastically deform to incline and axially displace toward their associated ends of the smoothing roller 32, as depicted in a chain line in FIG. 4.

Figure 4:
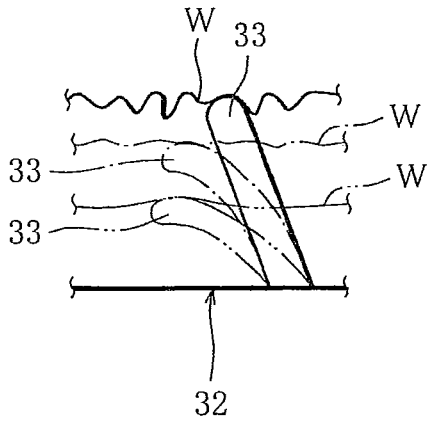
FIG. 4 shows how wrinkles in a web are flattened by the smoothing roller shown in FIG. 3.

As the smoothing roller further rotates, the force exerted by the web W winding around the smoothing roller on this portion of the circumference further increases, so that, at this portion of the circumference, the helical ridges 33 incline and axially displace to a greater extent, as depicted in a two-dot chain line in FIG. 4. The helical ridges 33 inclining and displacing in this manner pull the web W widthways outward, from the center to both sides. In addition, since the helical groove defined by each helical ridge 33 has a depth increasing toward the smoothing roller 32 end as mentioned above, each helical ridge 33 inclines to an extent increasing toward the roller end. Thus, the smoothing roller 32 contacts the web W not in a straight line parallel to the axis thereof, but in a circular arc line, that is, a longer contact line, resulting in the web W being satisfactorily pulled widthways outward, from the center to both sides, by the helical ridges 33 contacting it.

As the smoothing roller further rotates, the force exerted by the web W winding around the smoothing roller on the aforementioned specific portion of the circumference reduces, so that, at this portion of the circumference, the helical ridges 33 become gradually restored to the original position because of their elasticity, pulling the web W widthways inward, from both sides toward the center.

Thus, even if the web W has wrinkles, the winkles are removed satisfactorily by the web W being pulled widthways outward and then inward, when passing around the smoothing roller 32. In addition, after drying at the drying furnace 16, water is applied to the back side of the web W, all over the surface, at the water coating unit 20, so that the web W with softened wrinkles reaches the smoothing roller 32. This helps the smoothing roller 32 effectively remove the wrinkles.

The drying unit 30 provided as a post-dryer includes a drying roller 34 and a pair of pressing rollers 36. The drying roller 34 is a heat roller with a heater inside, and has a circumference heated to predetermined temperature. The drying roller 34 is connected to an adjustable-speed motor 45. The adjustable-speed motor 45 makes the drying roller 34 rotate at a peripheral speed higher than that of the feed roller 51. Because of this difference in peripheral speed between the drying roller 34 and the feed roller 51, predetermined tension is produced in the web W between the drying roller 34 and the feed roller 51 on the transport path L. The two pressing rollers 36 are in rotating contact with the circumference of the drying roller 34, with the web W interposed between, and determine the angle of the web W winding around the drying roller 34.

The two pressing rollers 36 can be brought into and out of contact with the drying roller 34 in a linked manner, for example by the following mechanism. The two pressing rollers 36 are each rotatably fitted to a pair of link arms (left and right link arms) 58*a*, 58*a* or 58*b*, 58*b*. The link arms 58*a*, 58*a* as well as the link arms 58*b*, 58*b* are rotatably supported by a shared support shaft 60, at their longitudinal center. The link arms 58*a*, 58*a* are connected by a connecting member at the end opposite to the end at which the pressing roller is fitted, and the link arms 58*b*, 58*b* are connected by a connecting member at the end opposite to the end at which the pressing roller is fitted. The connecting members are connected by an air cylinder 54. When a piston rod 56 in the air cylinder 54 is pushed up, the link arms 58*a*, 58*a* and 58*b*, 58*b* draw the pressing rollers 36 away from the drying roller 34, so that the web W ceases to be pressed against the drying roller 34. When the piston rod 56 is pulled down, the pressing rollers 36 move onto the drying roller 34 to press the web W against the drying roller 34.

The web W passes around the drying roller 34, being kept in close contact with the circumference of the drying roller 34 in a section between the two pressing rollers 36 to be dried by heat transfer from the circumference.

Downstream of the drying unit 30, a laser displacement sensor 42 and a backing roller 48 are arranged to face each other with the transport path L between. The backing roller 48 is in contact with the back side of the moving web W to guide the moving web W.

The displacement sensor 42 is arranged at a known distance from the backing roller 48 around which the web W passes and sends out a sensor signal representing the distance between the web W passing around the backing roller 48 and the displacement sensor 42, and thus, the size of wrinkles, as described below.

Figure 5A:
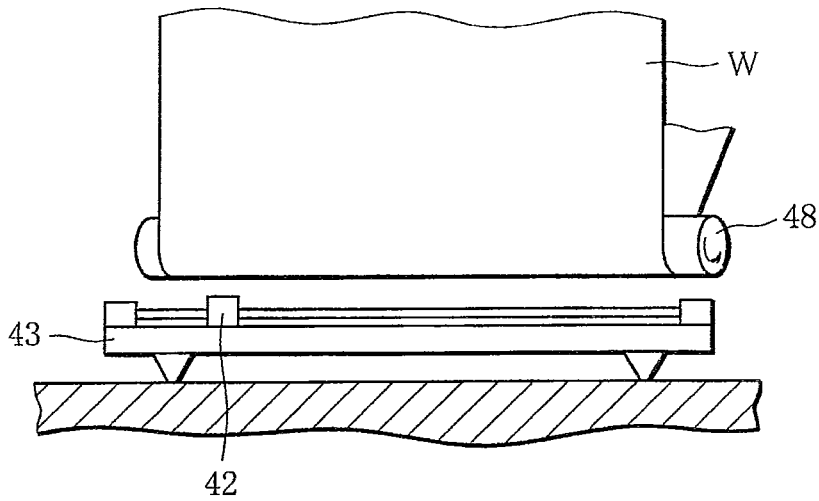
FIG. 5A is a diagram showing a displacement sensor and a linear slider.
Figure 5B:
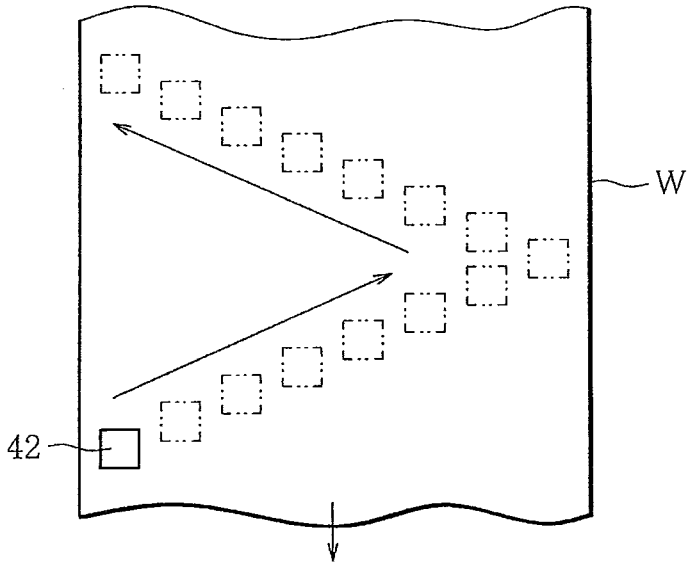
FIG. 5B is a diagram showing how the displacement sensor reciprocates.

Specifically, as shown in FIG. 5A, the displacement sensor 42 is attached to a linear slider 43. The liner slider 43 makes the displacement sensor 42 reciprocate across the moving web W. Thus, as shown in FIG. 5B, the displacement sensor 42 reciprocates obliquely across the moving web W, automatically measuring the size of wrinkles in the web W. Specifically, when the web W moves at the speed of 2.5 m/s, the displacement sensor 42 reciprocates across the web W at the speed of 1 m/s.

Figure 6:
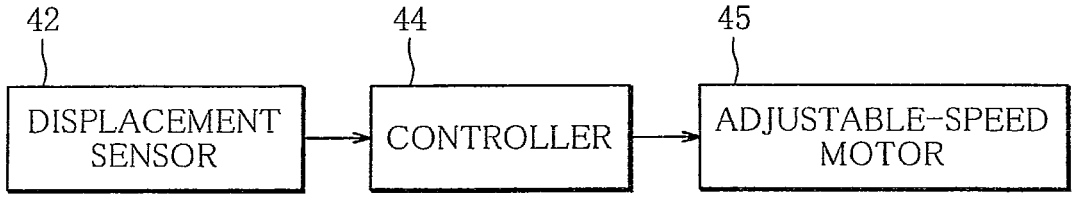
FIG. 6 is a block diagram showing connection between the displacement sensor and a controller in the apparatus shown in FIG. 1.

As shown in FIG. 6, the displacement sensor 42 is electrically connected to a controller 44, to which also the aforementioned adjustable-speed motor 45 is electrically connected. The controller 44 determines wrinkles remaining in the web W on the basis of the sensor signal from the displacement sensor 42, and depending on the determination results, regulates the speed of the adjustable-speed motor 45, and thus, the peripheral speed of the drying roller 34 as necessary, to regulate the tension in the web W. The controller 44 can also control the operation of the aforementioned air cylinder 54.

Figure 7:
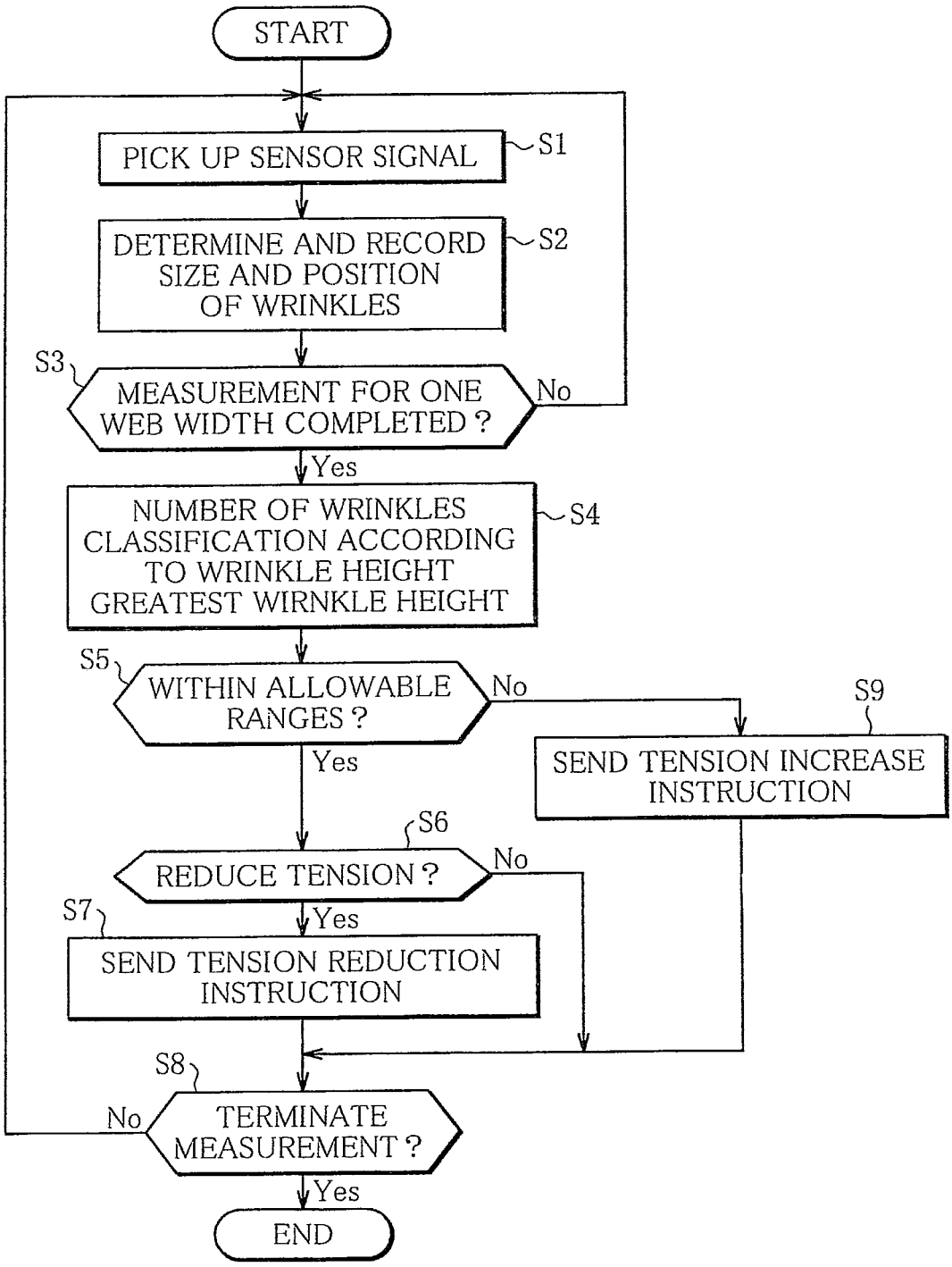
FIG. 7 is a flow chart for explaining how the controller functions.
Figure 8:
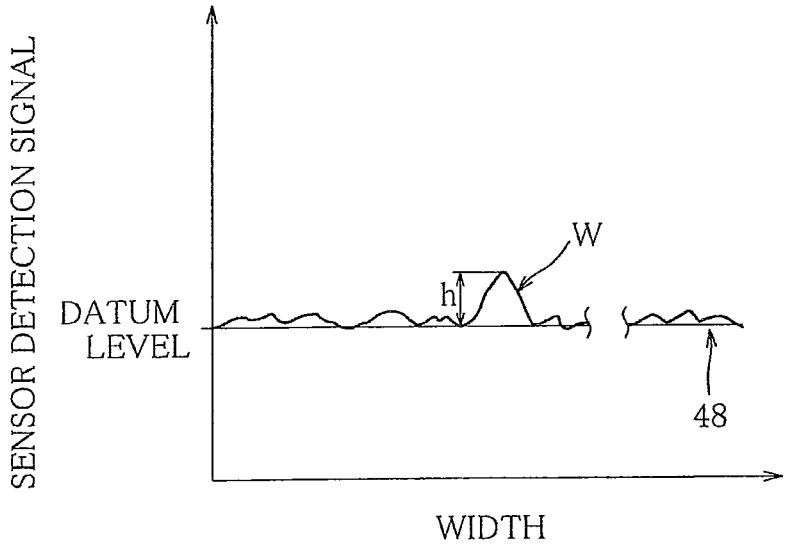
FIG. 8 is a graph showing how a sensor shown in FIG. 1 detects wrinkles in the web.

Specifically, the controller 44 controls the rotation speed of the adjustable-speed motor 45 according to a flow chart shown in FIG. 7. The controller 44 picks up the sensor signal from the displacement sensor 42 [step S1], determines the height and position of wrinkles from the sensor signal, and stores the size and position data [step S2]. As shown in FIG. 8, the size of a wrinkle is determined from a protrusion, or difference h between the distance obtained from the sensor signal and the known reference distance, i.e., distance between the backing roller 48 circumference and the displacement sensor 42. The position of a wrinkle is determined from the position of the linear slider 43.

The controller 44 then determines whether measurement for one web W width with the displacement sensor 42 has been completed [step S3], and if not ("No"), repeats steps 1 and 2. When the result of determination at step 3 changes to "Yes", the controller 44 obtains, at next step S4, information about wrinkles remaining in the web, such as the number of wrinkles in the web width concerned, how many wrinkles are included in each category of wrinkle height, and the greatest wrinkle height, from the stored data. The wrinkles are classified into, for example five categories of wrinkle height: 15 μm or greater, 25 μm or greater, 45 μm or greater, 55 μm or greater, and 70 μm or greater.

Then, the controller 44 determines whether the wrinkle-related quantities as mentioned above are within their allowable ranges [step S5]. If the result of determination is "Yes", the controller determines whether reduction in tension in the web W is allowable [step S6], and if the result of determination is "Yes", sends a web W tension reduction instruction to the adjustable-speed motor 45 [Step S7]. The determination at step S6 is made on the basis of differentials between the wrinkle-related quantities obtained at step S4 and their allowable limits.

According to the tension reduction instruction sent at step S7, rotation speed of the adjustable-speed motor 45 is reduced, so that the tension in the web W is reduced by means of the drying roller 34 by a predetermined amount.

If the result of determination at step S6 is "No", the controller 44 determines whether control is to be terminated, or in other words, the apparatus is to be stopped [step S8]. If the result of determination is "No", the controller 44 returns to step S1 to repeat the control routine.

If the result of determination at step S5 is "No", the controller 44 sends to the adjustable-speed motor 45 a web W tension increase instruction depending on the differentials between the wrinkle-related quantities and their allowable limits [step S9]. In this case, rotation speed of the adjustable-speed motor 45 is increased, so that the tension in the web W is increased by means of the drying roller 34 by a predetermined amount. The controller 44 then performs step S8.

The web W having passed through the displacement sensor 42 is wound on the take-up reel. The take-up reel with the web wound on is mounted on a cigarette making machine to make lower ignition propensity cigarettes. Alternatively, the web may be directly supplied to the cigarette making machine, without being wound on a take-up reel.

As clear from the above explanation, after the web W is coated with a combustion inhibition material and then dried, water is applied to the back side of the web, all over the surface. This softens wrinkles possibly produced in the web W during the drying. The web W then passes around the smoothing roller 32. Thus, the smoothing roller 32 can satisfactorily flatten the wrinkles in the web W passing around it.

If the web W having passed around the smoothing roller 32 is dried at the drying roller 34, production of wrinkles in the web W during this drying process is satisfactorily suppressed, because of the water applied to the back side of the web W, all over the surface.

In addition, the displacement sensor 43 is provided downstream of the drying roller 34 to quantitatively determine wrinkles remaining in the web W, and tension in the web W is regulated by means of the drying roller 34 depending on the wrinkles thus determined. This enables effective removal of wrinkles from the web W, and thus, great improvement in quality of the web W, or wrapping paper.

The present invention is not restricted to the above-described embodiment but can be modified in various ways.

For example, the apparatus includes smoothing rollers 32 and drying rollers 34 arranged in plural stages.

The smoothing roller 32 may be a roller performing another type of smoothing function.

The wrapping paper making apparatus 1 does not necessarily need to include a feed roller unit 50. If the gravure roller 22 of the water coating unit 20 is of the type capable of functioning also as a feed roller unit 50, predetermined tension may be produced in the web W by producing a difference in peripheral speed between the gravure roller 22 and the drying roller 34. The peripheral speed difference may be produced, for example by keeping the peripheral speed of the gravure roller 22 constant and regulating that of the drying roller 34, or keeping the peripheral speed of the drying roller 34 constant and regulating that of the gravure roller 22.

The apparatus and method according to the present invention is suited to make not only wrapping paper for lower ignition propensity cigarettes, but also other types of coated paper, such as packaging paper made by applying a liquid-form coating material, partly in particular, and printed paper.

Water may be applied to the front side of the web W to which a coating material has been applied.

The controller 44 may perform only the function of collecting and recording data related to wrinkles in the web W, from a sensor signal, and grasping the quality of the web W.

EXPLANATION OF REFERENCE CHARACTERS

1: Wrapping paper making apparatus
4: Band
10: Coating unit
12: Gravure roller
14: Pinch roller
16: Drying furnace (pre-dryer)
18: Guide roller
20: Water coating unit
22: Gravure roller
24: Pinch roller
28: Guide roller
30: Drying unit (post-dryer)
32: Smoothing roller
33: Helical ridge
34: Drying roller
36: Pressing roller
38: Guide roller
42: Sensor (measurement means)
43: Linear slider (measurement means)
44: Controller (tension regulation means)
45: Adjustable-speed motor (tension regulation means)
46: Communication line
48: Backing roller (measurement means)
50: Feed roller unit
51: Feed roller
52: Pinch roller
54: Air cylinder
56: Arm
58*a, b*: Arm
60: Support shaft
L: Transport path
W: Web

The invention claimed is:

1. Coated paper making apparatus comprising:

a transport path along which a web to be formed into coated paper is transported;

a liquid-form coating material coating unit arranged on said transport path to apply a liquid-form coating material to one side of the web;

a pre-dryer arranged downstream of said liquid-form coating material coating unit to dry the web;

a water coating unit arranged downstream of said pre-dryer to apply water to the web, all over a surface thereof; a post-dryer arranged downstream of said water coating unit to dry the web;

a smoothing roller rotatably arranged between said water coating unit and said post-dryer to flatten wrinkles in the web passing around said smoothing roller;

a measurement device for measuring wrinkles possibly remaining in the web having passed through said post-dryer and supplying measurements, the measurement device including:

a displacement sensor arranged at a predetermined distance from the transport path to measure a distance between the sensor and the web moving on the transport path, and a backing roller arranged along the transport path in a position opposite to the displacement sensor, the transport path being between the backing roller and the displacement sensor, the backing roller guiding the web by supporting the web moving beneath the backing roller on a side of the web opposite to a side on which the coating material is applied;

wherein the displacement sensor measures distance between the sensor and the web on the backing roller in a direction perpendicular to the surface of the web, to determine a size of the wrinkles in the web; and the apparatus further comprising:

a quality controller for managing the measurements received from said measurement device.

2. The coated paper making apparatus according to claim 1, wherein the measurement device also includes a linear slider for making the displacement sensor reciprocate across the moving web, at the predetermined distance from the transport path.

3. The coated paper making apparatus according to claim 1, further comprising:

a tension regulation device for regulating tension in the web passing around said smoothing roller so that said quality controller controls the tension in the web, through the tension regulation device, on the basis of the measurements received from said measurement device.

4. The coated paper making apparatus according to claim 3, wherein said post-dryer includes a drying roller for drying the web passing around it, and said tension regulation device includes an adjustable-speed motor for driving the drying roller at variable peripheral speed.

5. The coated paper making apparatus according to claim 4, wherein said post-dryer further includes a pair of pressing rollers arranged apart from each other in a circumferential direction of the drying roller, to press the moving web against a circumference of the drying roller.

6. The coated paper making apparatus according to claim 1, wherein, in order to make coated paper serving as lower ignition propensity wrapping paper for cigarettes, said liquid-form coating material coating unit is arranged to apply a liquid-form combustion inhibition material to the moving web, intermittently, thereby forming bands of the combustion inhibition material on the web.

7. The coated paper making apparatus according to claim 1, wherein the measurement device also includes a pair of guide rollers, the guide rollers defining a part of the transport path and determining an angle of the web winding around the backing roller.

* * * * *